US005261580A

United States Patent [19]

Smith

[11] Patent Number: 5,261,580

[45] Date of Patent: Nov. 16, 1993

[54] HAND WEARING APPAREL DISPLAY HANGER HAVING A CLIP AND A HOOK

[75] Inventor: Jasper N. Smith, Buffalo Grove, Ill.

[73] Assignee: Marmon Holdings, Inc., Chicago, Ill.

[21] Appl. No.: 25,697

[22] Filed: Mar. 3, 1993

[51] Int. Cl.[5] ..... A47G 25/14

[52] U.S. Cl. ..... 223/85; 223/DIG. 2; 206/495; 206/480

[58] Field of Search ..... 223/85, 90, 91, DIG. 1, 223/DIG. 2; 24/542, 355, 351, 347; 224/269, 252, 42.6; 206/495, 480, 806

[56] References Cited

U.S. PATENT DOCUMENTS

| | | | |
|---|---|---|---|
| 869,880 | 11/1907 | Conrad . | |
| 2,202,352 | 5/1940 | McGugin | 24/137 |
| 2,524,537 | 10/1950 | Osmonson | 223/90 |
| 2,682,122 | 6/1954 | Hanson | 40/2 |
| 2,732,934 | 1/1956 | Hall | 206/46 |
| 2,995,845 | 8/1961 | Fraser | 40/2 |
| 3,132,742 | 5/1964 | Shapiro et al. | 206/45 |
| 3,135,034 | 6/1964 | Fauteux | 24/137 |
| 3,144,721 | 8/1964 | Woloz | 35/56 |
| 3,292,223 | 12/1966 | Esposito | 24/137 |
| 3,414,175 | 12/1968 | Brosk | 223/85 |
| 3,496,616 | 2/1970 | Vazquez | 24/258 |
| 3,670,947 | 6/1972 | Tangredi et al. | 229/54 |
| 3,720,979 | 3/1973 | Krawagna | 16/150 |
| 4,071,930 | 2/1978 | Tanaka | 24/252 |
| 4,189,049 | 2/1980 | Silver | 206/216 |
| 4,335,838 | 6/1982 | Bisk et al. | 223/91 |
| 4,485,917 | 12/1984 | Smith | 206/278 |
| 4,514,885 | 5/1985 | Delahousse | 24/557 |
| 4,524,992 | 6/1985 | Linn | 281/45 |
| 4,662,039 | 5/1987 | Richardson | 24/489 |
| 4,716,634 | 1/1988 | Fan | 24/545 |
| 4,884,726 | 12/1989 | Kolton et al. | 223/91 |
| 5,052,086 | 10/1991 | Nasuno | 24/511 |
| 5,072,866 | 12/1991 | Kolton et al. | 223/91 |
| 5,193,676 | 3/1993 | Gold | 206/495 |

*Primary Examiner*—Clifford D. Crowder
*Assistant Examiner*—Bibhu Mohanty
*Attorney, Agent, or Firm*—James M. Wetzel; Jon Carl Gealow

[57] ABSTRACT

A hanger for securing a pair of gloves to each other and for hanging the pair of gloves from a peg. A hanger is formed with a hook, and a pair of ribs are provided on a pair of members which are spring loaded toward each other such that the ribs will engage the gloves therebetween to secure the gloves to each other and to the clip. A fastener is passed through a hole formed in each of the pair of members so as to prevent the ribs from being disengaged from each other unless the fastener is destroyed.

6 Claims, 1 Drawing Sheet

HAND WEARING APPAREL DISPLAY HANGER HAVING A CLIP AND A HOOK

BACKGROUND OF THE INVENTION

1. Field of the Invention

This invention related to a hanger having a clip for securing a pair of gloves to each other, and a hook for displaying the pair of gloves by placing said hook over a rod projecting from a vertical display panel. More particularly, it relates to a hanger having a clip which engages one side of each glove of a pair of gloves and is secured in engagement therewith by a locking fastener. The hanger also includes a hook which is used to hang the gloves for display purposes.

2. Description of Related Art Including Information Disclosed Under Secs. 1.97–1.99

U.S. Pat. No. 4,485,917, issued on Dec. 4, 1984, entitled: Hand Wearing Apparel Display Package and Method and Machine for Assembly Thereof, which is assigned to the assignee of the present application discloses a plastic tag having a hook projecting from one end and a portion to which the gloves are secured at the opposite end. As shown in FIG. 3*b*, the pair of gloves are secured to the tag by a staple. While this display arrangement has been successfully used, the need for improvements therein have been recognized. With the hanger arrangement revealed in the patent, the staple extends through one side of one of the gloves and through both sides of the other glove such that only one glove may be tried on. Currently available stapling equipment of the type shown in the above-mentioned patent cannot be used to staple together only the two adjacent sides of the two gloves. Further, on occasion, one of the ends of the staple may not be fully depressed against the surface of the tag, such that a person handling the gloves may be scratched by one of the sharp ends of the staple. While the staple may be carefully removed from the gloves and the tag, without damage to the gloves, the gloves may be pulled from the hanger in such a way as to damage the gloves as they are pulled from the staple.

A second embodiment of the hand wearing apparel display package is shown in FIG. 3*a* of the 4,485,917 patent. In this embodiment the gloves are attached to a plastic hanger and a labelling tag by a plastic fastener which is inserted through the glove material and the labelling tag by a hollow needle which also passes through a hole provided in the plastic hanger. While the plastic fastener eliminates some of the above-mentioned problem associated with the use of a staple, such as injuries from contact with the ends of the staple and damage to the gloves from careless removal of the staple, it does have other drawbacks. The principal ones being that the plastic fastener does not compress the glove material to hold the gloves tightly against the labeling tag and plastic hanger.

As Will subsequently become apparent, the hanger of this invention includes a spring loaded clip member. A spring loaded clip, similar in its manner of operation to that of this invention but differing in the details of its construction due to their different intended uses, is shown in U.S. Pat. No. 4,884,726, issued on Dec. 5, 1989 entitled: Hanger For Supporting Plural Garments.

SUMMARY OF THE INVENTION

In providing a hanger for displaying a pair of gloves to potential purchasers, it is desirable that the potential purchaser be able to try on both the right and left hand glove, while at the same time not permitting the pair of gloves to be separated from each other. It is also desirable that the hanger provide for hanging the pair of gloves from a peg on a display rack. It is further desirable, after a pair of gloves has been purchased, that the hanger holding the pair of gloves together be readily disengaged from the gloves without, in any way, damaging the gloves. The hanger for securing the pair of gloves to each other and for displaying the gloves should be readily secured to a pair of gloves with a minimum amount of manipulation and labor.

It is an object of this invention to provide a hanger for securing a pair of gloves to each other and for displaying the gloves which is easily applied to the gloves, and secured with a fastener which must be removed with an implement before the gloves can be removed from the hanger. It is a further object of this invention to provide a clip and hook which is easily applied and secured to a pair of gloves with a minimum amount of labor and effort.

In accordance with one embodiment of this invention, a plastic hanger for displaying a pair of gloves is provided which is formed with a first generally flat elongated portion which is provided with a hook at one end and with a glove engaging portion at the other end in the form of a first rib projecting therefrom which engages a glove. A second portion of the hanger, which extends from a side of the first portion includes a second glove engaging portion in the form of a member having a second rib, opposing the first rib for engaging a glove. A third portion of the hanger forms a spring loading member which provides the first and second portions with two stable positions with respect to each other, thus forming a snap clip with two stable positions. In one stable position, the glove engaging ribs are separated from each other with the rib bearing first and second portions being at generally right angles to each other. In the second stable position, the glove engaging ribs are spring loaded toward engagement with each other such that the gloves are secured therebetween.

The distal ends of the first and second portions bearing the glove engaging ribs are provided with holes therethrough in alignment with each other for receiving a locking fastener. The hanger is applied to a pair of gloves by positioning the rib bearing portions of the hanger over the wrist openings of the glove, with one side of each of the gloves positioned between the ribs. The adjacent sides of the gloves are secured between the two ribs of the clip when the second member is moved from its first stable position to its second stable position. A force provided by the spring loading member applies a holding force pushing the ribs into engagement with the sides of the gloves. To complete the application of the plastic display device to the pair of gloves, a plastic fastener is passed through a hole in one of the members, pierced through the glove and passed through a hole in the member on the opposite side. The fastening member is a type which normally may only be removed by using an implement to destroy the fastener.

DETAILED DESCRIPTION OF THE PREFERRED EMBODIMENT

Figure 1:
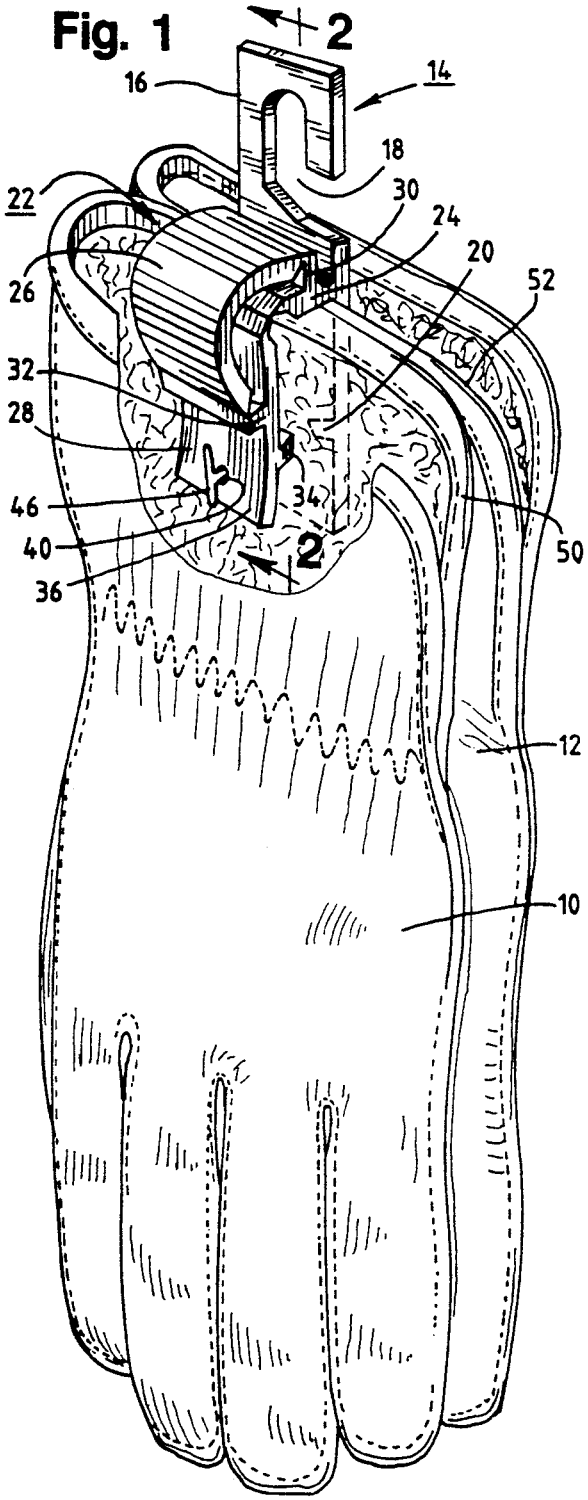
FIG. 1 is a perspective view showing the glove hanger secured to a pair of gloves.

In FIG. 1 a pair of gloves consisting of a left hand glove 10 and a right hand glove 12 are shown secured to each other by a hanger 14 constructed in accordance with this invention. The hanger 14 is formed with a first generally rectangular flat portion 16 having a L-shaped notch formed in one end and a glove engaging rib 20 provided on one side near the opposite end. A second portion 22 of the hanger is formed on the same side of the flat portion 16 as the rib 20 and extends from the flat portion 16 at a location between the L-shaped notch 18 and the rib 20. The second portion 22 includes a short portion 24 which projects at right angles from the flat portion 16 and which supports a spring member 26 and a rib bearing member 28. Hinge portions 30 and 32 support the spring member 26 from the short portion 24 and the rib bearing member 28 respectively. With the hanger 14 formed as a molded plastic part the hinge portions 30 and 32 are attached to spring member 26 by portions of very thin cross-section which thus forms resilient hinges.

Figure 2:
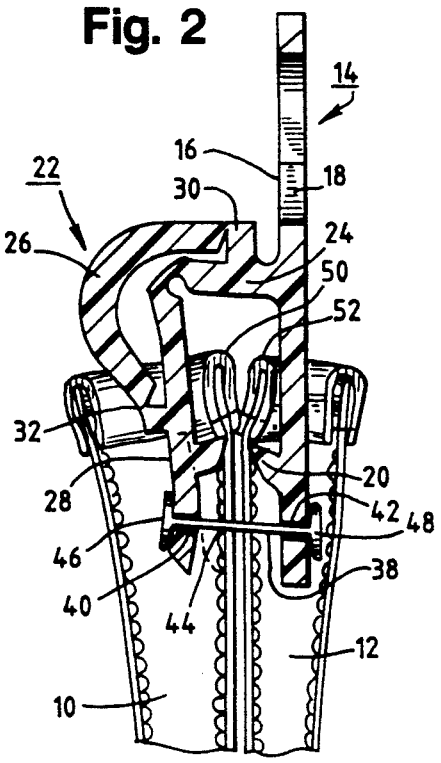
FIG. 2 is a cross-sectional view of the glove hanger taken along the line 2—2 in FIG. 1.
Figure 3:
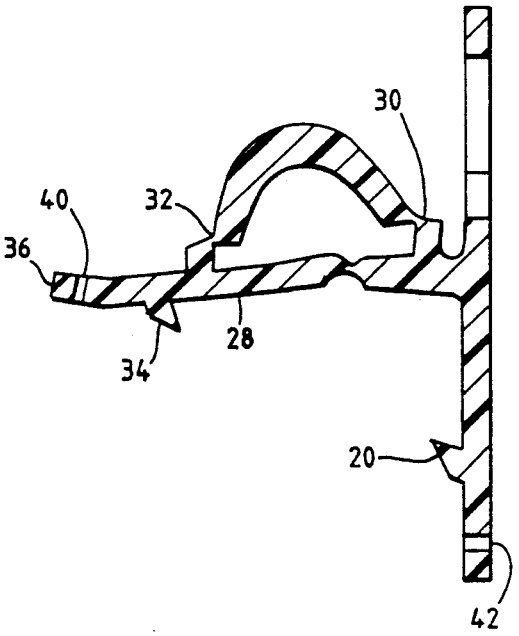
FIG. 3 is a cross-sectional view corresponding to FIG. but with the glove hanger in its second stable position.

The portions 16 and 28 of the clip which bear ribs 20 and 34 have two stable positions with respect to each other, one as shown in FIG. 2 and the other as shown in FIG. 3. In applying the hanger 14 to a pair of gloves 10 and 12, the pair of gloves is positioned with the palm sides facing each other as shown in FIG. 1, adjacent to the rib 20 as shown in FIG. 3. A downward force is then applied to free end 36 of the member 28, which upon passing an over-center position will snap into engagement with the outer glove (10 as shown in FIG. 1) to secure the palm sides of the gloves between the projecting ribs 20 and 34 as shown in FIG. 3.

To discourage, if not to prevent, the removal of the hanger 14 from the gloves until after the gloves have been purchased, a fastener 38 which cannot be removed without the use of an implement, is passed through a pair of holes, 40 in member 28, and 42 in member 16. One such securing device which may be easily applied is the so-called "Dennison fastener". This fastener has a central cylindrical body portion 44 and end members 46 and 48 which after installation, extend at right angles from the body portion. This type of fastener is installed by a implement which includes a hollow needle through which the body portion 44 and a first one of the end members 46 pass with the end member 24 and the body portion 44 axially aligned with each other. After the needle is inserted through one of the holes, the palm side of each of the gloves and the second hole, actuation of a trigger mechanism on the installation tool pushes the body portion 44 of the fastener and the end member 46 from the hollow needle such that the end member 46 will automatically open to a position at right angles to the body portion. Thus, unless one of the end members is removed from the body portion, such as by cutting, or the body portion itself is severed, the hanger clip may not be opened to remove the gloves therefrom.

In a preferred embodiment of this invention, the entire securing and display device 14, other than the fastener 38 may be formed as a single molded or extruded plastic part.

With the hanger of this invention applied to a pair of gloves, the gloves may be hung from a peg projecting from a display board by use of the L-shaped notch. A potential customer may remove the pair of gloves from the peg and, due to the manner in which the clip is applied to the gloves, may readily insert his left hand into the left hand glove or right hand into the right hand glove to assure that both gloves have a desired fit. As compared to the prior art device set forth above, where there is a possibility of the staple scratching one's hand, that is not an inherent problem with the device of this invention.

After purchase, the gloves may easily be removed from the clip by removing one of the ends from the fastener, such as by using a finger nail clipper or other cutting instrument. With the fastener disabled, one need merely reach under the end 36 of the spring loaded member 28 and apply a sufficient upward force to return the member to its second position as shown in FIG. 3, thereby release the pair of gloves for use.

It should be recognized, that while there are few, if any, subsequent uses for the tag-type hanger disclosed in the prior art patent set forth above, the hanger of this invention may find many subsequent uses after it is removed from a pair of gloves. For instance, it may be used to store the gloves which were originally retained by it. In other cases, it may be used to support some other object from a peg.

At best seen in FIGS. 1 and 2, the hanger of this invention is particularly adapted for use with gloves that are provided with bound or hemmed cuffs such as 50 and 52 as shown in FIGS. 2 and 3. With the enlarged thickness of the cuffs positioned above the ribs 20 and 34 as shown in FIGS. 1 and 2, attempting to pull the gloves from the clip by breaking the fastener 38 would be unsuccessful since the ribs would engage the thickened cuff portions.

It should be apparent to those skilled in the art that what has been described is considered at present to be the preferred embodiment of the display hanger of this invention. In accordance with the Patent Statutes, changes may be made in the display hanger without actually departing from the true spirit and scope of this invention. For instance, the particular shape of the hanger, the substitution of an aperture for the L-shaped slot, variations in the form of the ribs, and other such modifications may be made without departing from the true spirit of this invention.

The appended claims are intended to cover all such changes and modifications which fall in the true spirit and scope of this invention.

I claim:

1. A device for displaying a pair of gloves comprising;

an elongated first member having a first end portion, a second end portion and a middle portion, said first end portion being provided with a support means for supporting said device from a display rack, said second end portion being provided with a first rib for engaging a glove, and with a first aperture, an elongated second member having a first end portion, a second end portion and a middle portion, said first end portion of said second member supported from said middle portion of said first member, said second end portion of said second member provided with a second rib for engaging a glove, and with a second aperture, an elongated third member having a first end portion and a second end portion, said first end portion supported from said middle portion of said first member, said second end portion supported from said middle portion of said second member, said third member including means providing a spring biasing force between said first and second members such that said first and second members have two stable positions with respect to each other, including a first of said stable positions whereby said second end portions of said first and second members are held apart from each other and a second of said stable positions said second end portions whereby being biased toward each other such that with one of the sides of each glove of a pair of gloves placed between said second end portions of said first and second members said first and second ribs engage the gloves from opposite sides with said first and second ribs in close proximity to each other to grasp the pair of gloves, and further comprising a securing means passed through said first and second apertures in said first and second members, and through the portions of the gloves located between the apertures, such that said second end portions of said first and second members cannot be moved to said first stable position apart from each other so as to permit removal of the device from the gloves without removing said securing means.

2. The device of claim 1, wherein said elongated first, second and third members are formed as a unitary plastic member.

3. The device of claim 1, wherein said support mean is formed as an L-shaped slot in said first end portion of said elongated first member.

4. The device of claim 1, wherein said elongated third member is supported from said middle portions of said first and second members by hinges.

5. The device of claim 1, wherein said elongated first, second and third members and said hinges are formed as a unitary plastic member.

6. The device of claim 1, wherein said securing means has an elongated body portion and two end portions, said elongated body portion extending through said first and second apertures and the portions of the gloves located between the apertures, and said end portions of said securing means engages the second end portions of the elongated first and second members to prevent their movement to said first stable position.

* * * * *

UNITED STATES PATENT AND TRADEMARK OFFICE

CERTIFICATE OF CORRECTION

PATENT NO. : 5,261,580

DATED : November 16, 1993

INVENTOR(S) : Jasper N. Smith

It is certified that error appears in the above-identified patent and that said Letters Patent is hereby corrected as shown below:

Col. 3, line 2, after "FIG." insert - 2 -.

Claim 1, col. 5, line 11, after "positions" insert - whereby - line 12, delete "whereby being" and substitute - are -.

Signed and Sealed this

Tenth Day of May, 1994

*Attest:*

*Attesting Officer*

BRUCE LEHMAN

*Commissioner of Patents and Trademarks*